United States Patent [19]

Perfect

[11] 4,119,457

[45] Oct. 10, 1978

[54] MOLYBDENUM-TITANIUM-ZIRCONIUM-ALUMINUM MASTER ALLOYS

[75] Inventor: Frederick H. Perfect, Wymossing, Pa.

[73] Assignee: Reading Alloys, Inc., Robesonia, Pa.; a part interest

[21] Appl. No.: 801,087

[22] Filed: May 27, 1977

[51] Int. Cl.[2] ..... C22C 28/00; C22C 30/00; C22C 16/00

[52] U.S. Cl. ..... 75/134 N; 75/177

[58] Field of Search ..... 75/177, 175.5, 176, 75/134 F, 134 N, 138, 135

[56] References Cited

U.S. PATENT DOCUMENTS

| | | | |
|---|---|---|---|
| 3,625,676 | 12/1971 | Perfect | 75/135 |
| 3,725,054 | 4/1973 | Perfect | 75/134 F |

FOREIGN PATENT DOCUMENTS

| | | | |
|---|---|---|---|
| 297,695 | 3/1971 | U.S.S.R. | 75/138 |

OTHER PUBLICATIONS

"Phase Equilibria in the Ti-Al-Mo-Zr System", Volkova, M.A., Kornilov, II; Russian Metallurgy, No. 6, 1968, pp. 133-136.

*Primary Examiner*—L. Dewayne Rutledge
*Assistant Examiner*—Peter K. Skiff
*Attorney, Agent, or Firm*—Howson and Howson

[57] ABSTRACT

This invention relates to molybdenum-titanium-zirconium aluminum master alloys containing about 20 to 25% molybdenum, about 1 to 5% titanium, about 40 to 50% zirconium, balance aluminum and not more than about 0.004% nitrogen.

3 Claims, No Drawings

MOLYBDENUM-TITANIUM-ZIRCONIUM-ALUMINUM MASTER ALLOYS

DESCRIPTION OF THE INVENTION

Titanium base alloys such as the alloys 6Al-2Sn-4Zr-2Mo and 6Al-2Sn-4Zr-6Mo find use in the manufacture of certain aircraft. Heretofore, these titanium base alloys have been produced through the addition of a 45Al-55Mo master alloy and zirconium sponge to titanium base metal. However, it has been found that the resultant alloys may contain nitride inclusions thought to emanate from zirconium sponge. Hence, there is a need for zirconium containing master alloys for use in preparing the titanium base alloys described above. Master alloys thought to be useful in the manufacture of titanium alloys containing 30–45% Mo, 20–30% Zr, balance aluminum are described in USSR Pat. No. 297,695 cited in Chemical Abstracts, Volume 75-90831x. U.S. Pat. Nos. 3,625,676 and 3,725,054, disclose vanadium, aluminum, titanium and molybdenum, titanium, aluminum master alloys, respectively.

According to this invention there is provided molybdenum-titanium-zirconium-aluminum master alloys containing from about 20 to about 25% molybdenum, from about 1 to about 5% titanium, from about 40 to about 50% zirconium, balance aluminum, said alloys containing not more than about 0.004% by weight, nitrogen and being suitable for use in making titanium base alloys.

The master alloys are produced by the aluminothermic reduction of the oxides of molybdenum, titanium, and zirconium with excess aluminum to metallic molybdenum, titanium and zirconium which combine with aluminum forming the desired master alloys. It has been found that master alloys having a composition described herein are homogeneous, friable, substantially free of slag, and remarkably low in nitrogen content. In addition, the master alloys can be sized to ⅜ by 100 mesh without creating substantial quantities of pyroforic fines, and combine readily with titanium sponge in this form.

The master alloys of this invention may be produced in any suitable apparatus. A preferred type of reaction vessel is a water-cooled copper vessel of the type described in "Metallothermic Reduction of Oxides in Water-Cooled Copper Furnaces," by F. H. Perfect, transactions of the Metallurgical Society of AIME, Volume 239, August '67, pp. 1282–1286.

In producing the master alloys of this invention, oxides of molybdenum, titanium, and zirconium, are reduced to a relatively small size, and intimately mixed so that reaction will occur rapidly and uniformly throughout the charge on ignition. An excess of aluminum is used to produce the alloy. Ignition of the reaction mixture may be effected by heating the charge to above the melting point of aluminum by an electric arc, gas burners, hot metal bar, wire or the like.

Relatively pure polybdic oxide (molybdenum dioxide), containing 99 plus % $MoO_3$, or very pure calcium molybdate, may be used as the source of molybdenum.

It is preferred to use pigment grade titanium dioxide which analyzes 99 plus % $TiO_2$ as the source of titanium. However, less pure $TiO_2$-containing material, such as native rutile, which analyzes about 96% $TiO_2$, and contains minor amounts of the oxides of Fe, Si, Zr, Cr, Al and Ca as well as S and P, as impurities, may be employed. Commercial grade $TiO_2$ is preferable since its use enhances the purity of the resulting master alloy.

Relatively pure zirconium oxide ($ZrO_2$) or Baddeleyite containing 99% $ZrO_2$ may be used as the source of zirconium.

The aluminum powder should be of the highest purity available commercially. Virgin aluminum powder analyzing an excess of 99% aluminum, is the preferred reducing agent and addition agent.

Due to natural variance in purity of the metal oxide and aluminum reactants, the proportion of the constituents required to provide master alloys of a given composition will vary. For this reason, the respective amounts of materials used are expressed in terms of the composition of the desired alloy. As stated above, the amount of the components should be so proportioned as to provide master alloys containing from about 20 to about 25% molybdenum, from about 1 to about 5% titanium, from about 40 to about 50% zirconium, balance aluminum. The master alloys produced contain not more than about 0.004%, by weight, nitrogen, and incidental amounts of boron, carbon, iron, hydrogen, oxygen, phosphorous, silicon, and sulfur. Preferred master alloys comprise from about 21 to about 24% molybdenum, from about 3 to about 5% titanium, from about 43 to about 46% zirconium, balance aluminum.

A calcium aluminate slag is produced during the reaction, and the reaction is carried out in the presence of a molten flux which dilutes the slag and renders it more fluid in order that the slag may be separated from the alloy. The flux must be capable of diluting the slag formed by the reaction to produce a less viscous slag which separates readily from the alloy. The fluorides and chlorides of metals such as Ca, Na, and K, alone or in combination with other inorganic materials, are particularly suitable for forming slag-absorbing fluxes.

The amount of flux-forming agents employed should be sufficient to provide an amount of molten flux capable of diluting the slag formed during oxide reduction to provide a less viscous slag which is readily separated from the metal. Preferably an excess of flux over that needed to obtain the desired reduction in slag viscosity is used. The excess may be from about 0.5 to 2 times the weight of the slag formed in the process.

The resulting molybdenum-titanium-zirconium-aluminum master alloys are homogenous, relatively void free and, as noted above, contain less than 0.004% nitrogen, by weight, Moreover, the master alloys of this invention are clean, and free of gross nitride inclusions.

The master alloys can be reduced in particle size to 8 mesh or less to permit fluoroscopic examination. When reduced to this size, the master alloys become relatively transparent to fluoroscopic inspection. Of course, reduction of the master alloy to 8 mesh or less, creates a hazard since many pyroforic fines are produced. Hence, the master alloy is typically reduced to ⅜ by 100 mesh, and in this form, may be blended with a titanium sponge in sufficient amounts to provide the desired titanium base alloys.

The following examples are illustrative of the invention:

EXAMPLE I

The materials in Table I were combined and mixed together:

Table I

| Ingredient | Weight (lbs.) |
|---|---|
| $MoO_3$ | 21 |
| $TiO_2$ | 3 |
| $ZrO_2$ | 64 |
| Baddeleyite | |
| Al | 56 |
| $CaF_2$ | 20 |
| CaO | 20 |
| $NaClO_3$ | 25 |

After mixing, the charge was placed in a crucible, ignited and allowed to run 64 to 68 seconds. Metal-slag separation was good, and the resultant alloy weighed 58 lbs. The analysis of the alloy is in Table II.

Table II

| | Percent |
|---|---|
| Mo | 21.40 |
| Ti | 2.75 |
| Zr | 44.30 |
| Al | 30.45 |
| N | 0.0039 |
| O | 0.141 |

EXAMPLE II

Following the procedure of Example I, an alloy was prepared from the mixture shown in Table III.

Table III

| Ingredient | Weight (lbs.) |
|---|---|
| $MoO_3$ | 21 |
| $TiO_2$ | 4 |

Table III-continued

| Ingredient | Weight (lbs.) |
|---|---|
| $ZrO_2$ (pure) | 16 |
| $ZrO_2$ (Baddeleyite) | 48 |
| Al | 56 |
| $CaF_2$ | 20 |
| CaO | 20 |
| $NaClO_3$ | 25 |

The resulting alloy has the analysis shown in Table IV.

Table IV

| | Percent |
|---|---|
| Mo | 21.65 |
| Ti | 3.85 |
| Zr | 43.65 |
| Al | 30.20 |
| N | 0.0037 |
| O | 0.14 |

Having thus described the invention, what is claimed is:

1. A molybdenum-titanium-zirconium-aluminum master alloy comprising from about 20 to about 25% molybdenum, from about 1 to about 5% titanium, from about 40 to about 50% zirconium, balance aluminum, said alloy containing not more than about 0.004%, by weight, nitrogen.

2. The master alloy of claim 1 comprising from about 21 to about 24% molybdenum, about 3 to about 5% titanium, from about 43 to about 46% zirconium, balance aluminum.

3. The master alloy of claim 2 comprising about 21.4% molybdenum, 2.7% titanium, 44.3% zirconium, balance aluminum.

* * * * *